United States Patent [19]

Williams

[11] Patent Number: 4,587,746

[45] Date of Patent: May 13, 1986

[54] SOLE AND HEEL SHOE TAP

[76] Inventor: Alvin Williams, Apt. 4B, 720 Lenox Avenue, New York, N.Y. 10039

[21] Appl. No.: 712,333

[22] Filed: Mar. 14, 1985

Related U.S. Application Data

[63] Continuation of Ser. No. 454,662, Dec. 30, 1982, abandoned.

[51] Int. Cl.[4] ..... A43B 13/22

[52] U.S. Cl. ..... 36/73

[58] Field of Search ..... 36/73, 71.5, 72 R, 72 B, 36/82, 135

[56] References Cited

U.S. PATENT DOCUMENTS

| | | | |
|---|---|---|---|
| 200,505 | 2/1878 | Buxton | 36/73 X |
| 1,875,152 | 8/1932 | Reynolds | 36/73 |
| 2,017,038 | 10/1935 | Carelli | 36/73 |
| 2,410,853 | 11/1946 | Wood, Jr. | 36/73 |
| 2,522,830 | 9/1950 | Leganger-Krogstad | 36/73 X |
| 3,414,990 | 12/1968 | Kessler | 36/73 |

FOREIGN PATENT DOCUMENTS

| | | | |
|---|---|---|---|
| 19479 | 2/1930 | Australia | 36/73 |
| 103723 | 2/1917 | United Kingdom | 36/73 |

*Primary Examiner*—Werner H. Schroeder
*Assistant Examiner*—T. Graveline
*Attorney, Agent, or Firm*—Evelyn M. Sommer

[57] ABSTRACT

A metal shoe tap provided with a top thin flat horizontal member, a thin lip peripherally secured to said member and extending vertically downward to a bottom essentially horizontal edge, and a plurality of thin horizontally elongated plates which are either parallel or perpendicular to each other. The plates are secured to each other, to the bottom surface of the member and to the lip and extend downward to lower edges which are co-planar with the bottom edge of the lip. These plates define a plurality of generally rectangular cells open at the bottom and closed at the top with certain of said cells having an opening extending entirely through said thin flat horizontal member adapted for receiving a fastening member such as a screw.

2 Claims, 6 Drawing Figures

SOLE AND HEEL SHOE TAP

This application is a continuation of application Ser. No. 454,662, filed 12/30/82.

BACKGROUND OF THE INVENTION

Metal shoe taps securable to shoes of dancers, golfers and others engaging in strenuous activities are well known. The present invention is directed toward a new type of metal shoe tap which is adapted to be secured to the sole and or heel of a shoe provided with a bottom surface, sole and heel, of rubber, rubber sponge or leather for the purpose of minimizing wear when the shoe is in normal use. This tap is so constructed that it can provide added cushioning and sound deadening action. This tap is not intended for use on dancers shoes for the express purpose of producing metallic sounds or on golfers shoes where the purpose is for increasing friction or stabilizing the foot on a slippery surface, or the like; it is intended in the main for reducing wear in the manner hereinafter explained. In this connection it can be used on a dancers shoe, for example where the objective is to preserve the shoe heel and or sole.

SUMMARY OF THE INVENTION

In accordance with the principles of the invention, a shoe tap is adapted to be secured to the bottom surface of a shoe at the heel and or sole to minimize wear when the shoe is in use. The tap comprises a thin flat horizontal metal member. A thin metal lip is secured to or preferably formed in one piece with the said member along the periphery thereof and extends vertically downward to a bottom edge which is essentially horizontal. A plurality of thin straight horizontally elongated metal plates are also employed. Some of these plates are parallel to each other. Others are perpendicular to each other. The plates are secured to each other, to the bottom surface of the member and to said lip and define a plurality of generally rectangular cells which have bottom edges disposed in a common plane with the bottom edge of the lip. The bottom ends of the cells are open. The top ends of the cells are closed by said member. The bottom ends of the cells other than those provided with screws or the like for fastening the shoe tap to the shoe are at the time of manufacture filled with a cushioning material such as a rubber or other elastomeric resin. The cells provided with the screws are left empty of resin to provide access for attaching the tap to the shoe sole and or heel.

Selected cells each have one vertical opening extend-through the member. In use, a screw is disposed in each selected cell and extends upwardly through the corresponding opening into the bottom surface of the shoe to secure the tap in position. The cells with the exception of thos holding a screw then can be filled with a sound deadening and cushioning material such as rubber resin.

The tap of the invention is particularly adapted for use on a rubber or gum heel and or sole, especially where those parts are constructed as a single unit. Such shoes are particularly subject to wear and in the average case to uneven wear, for instance at the heel's outer edge. Repair or replacement of the worn heel portion of such a shoe is not practical or possible as in the cases where it is possible, it is very expensive so that the better alternative is to dispose of the shoe and buy a new pair. The tap of the invention solves this problem by prolonging the lift of the shoe. It is estimated that a shoe provided with a tap as herein described and claimed worn substantially continuously lasts until the tap wears out i.e., for periods of one year or more. The same benefits and advantages are realized when the tap is placed on shoes provided with leather heels and or soles.

DETAILED DESCRIPTION OF PREFERRED EMBODIMENTS

Figure 1:
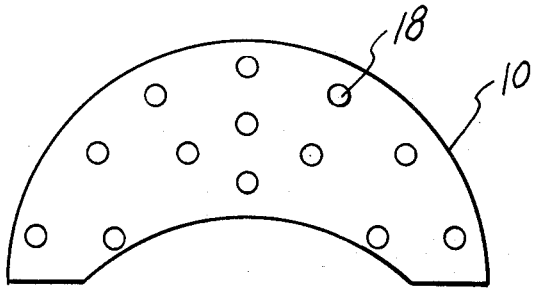
FIG. 1 is a top view of a tap in accordance with the invention ready for installation.

Referring to FIGS. 1–6, a horizontal thin flat metal member 10 has a lip 12 secured to or formed integral (as a unit) with the periphery of the member and extending vertically downward to a bottom edge which is essentially horizontal. The lip is thin, and is made of the same metal (typically the metal used to make sheet metal screws) as the member.

A plurality of thin straight horizontally elongated metal plates 14, made of the same metal as above, are secured to the bottom surface of the member, to the lip and to themselves. Some of the plates are parallel to each other. Other plates are perpendicular to each other.

The plates thus form a plurality of rectangular cells 16 which have open bottom ends which are in a common plane with the bottom edge of the lip and have top ends closed by the member. Selected cells have vertical openings 18, one per cell, which extend through the member 10.

The member 10 is pressed against the bottom surface 20 of shoe 22 and sheet metal screws 25 are inserted into the openings and tightened until the shank 24 of the screw extends into an opening 44 in the surface 20 and the enlarged head 26 of the screw extends from the member to a point above the bottom end of the particular cell.

Figure 4:
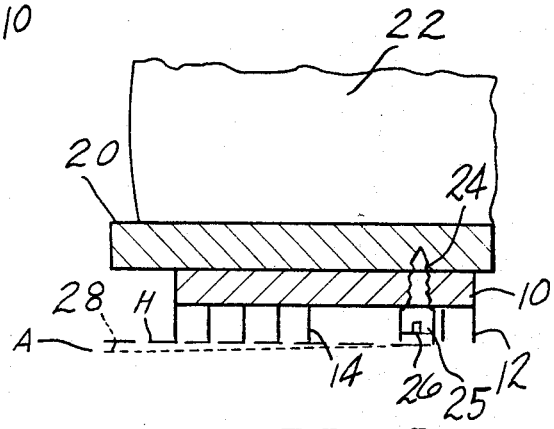
FIG. 4 is an enlarged detail partially cut away, cross-sectioanl view of the circled heel portion of the shoe of FIG. 3.
Figure 2:
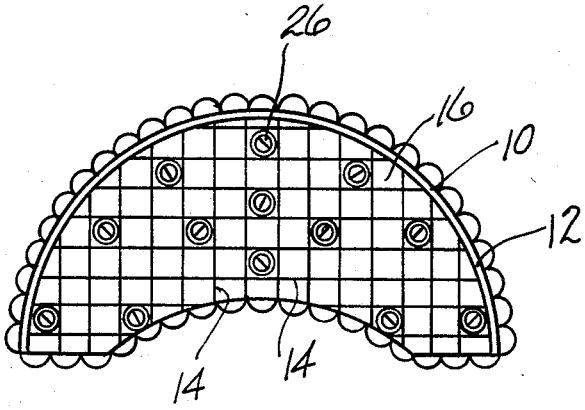
FIG. 2 is a bottom view of the tap of FIG. 1.

The common plane of the plates and lip is shown at 28 in FIG. 4. Typically this plane is inclined about five degrees (5°) (angle A in FIG. 4) from the front to the back of the shoe relative to the horizontal H.

Figure 5:
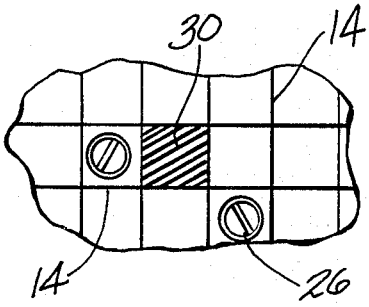
FIG. 5 is a detail bottom view of the tap with screws and cushioning and sound deadening material therein.

Rubber 30 or other materials such as resin, which can be used to fill the cells for the purposes of cushioning and for sound deadening can be poured in a viscous state and allowed to solidfy as shown in FIG. 5. For the purposes of installation, removal or replacement the screw heads have been shown uncovered.

The tap can be manufactured with or without the screws in place. In a preferred form of manufacture, the screws are manufactured so that the screws can not be removed, or accidentally lost.

The tap is conveniently made of sheet metal as can the screw.

Figure 6:
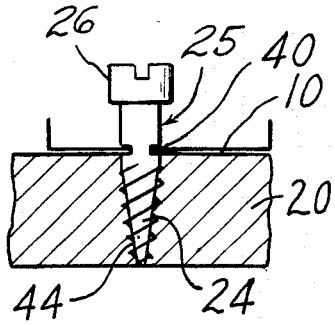
FIG. 6 is a detail of a preferred form of screw for use with the tap.
Figure 3:
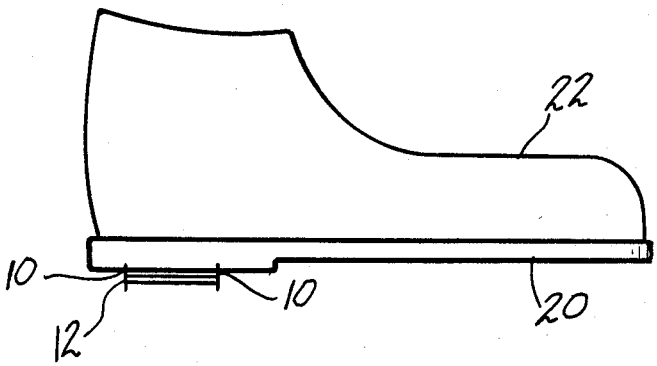
FIG. 3 is a side view of the tap as secured to a shoe.

As noted above, the tap can be manufactured with the screw forming an integral part thereof. In this case the screw is as shown in FIG. 6. The screw shank 24 in this case is provided with a recess or groove 40 designed so that the screw can be tightened and force the member 10 against the bottom surface 20 of the shoe.

While various preferred embodiments of this invention have been described and illustrated, it will be understood by those in the art that changes and modifications may be resorted to without departing from the spirit and scope thereof.

I claim:

1. A sheet metal shoe tap adapted to be secured to the bottom surface of the sole and/or heel of a shoe to minimize wear thereof when the shoe is in use, said tap comprising:

a thin flat horizontal member having an upper surface adapted to bear against the bottom surface of the shoe and a lower surface;

a metal lip formed integral with the lower surface of said member along the periphery thereof and extending vertically downward, said lip terminating in an essentially horizontal bottom edge;

a plurality of thin straight horizontally elongated metal plates, some plates being parallel to each other, other plates being perpendicular to each other, said plates being integrally joined with each other and to said lip and to the lower surface of said member, the lower edges of said plates and the bottom edge of said lip lying in a common plane, said plates cooperating with said lip and the lower surface of said member to define a plurality of generally rectangular cells open at bottom ends coincident with said plane and closed at the top end by said member, selected ones of said cells each having one vertical opening extending entirely through said member, the remaining cells lacking said opening, wherein said common plane is inclined at about a five degree angle relative to the horizontal in the direction of the heel portion of said shoe;

a plurality of sheet metal screws equal in member to the number of openings, each screw having an enlarged head larger in area to the cross sectional area of an opening, each screw extending upwardly through a corresponding opening into the shoe with the head disposed within the corresponding cell to secure the member to a position above the common plane; and sound deadening and cushioning material filling each of said remaining cells.

2. A tap as set forth in claim 1 wherein said material is rubber.

* * * * *